US009068543B2

(12) United States Patent
Besancon et al.

(10) Patent No.: US 9,068,543 B2
(45) Date of Patent: Jun. 30, 2015

(54) FUEL INJECTION SYSTEM WITH INTEGRATED HIGH-PRESSURE ACCUMULATOR

(75) Inventors: Sylvain Besancon, Gerlingen (DE); Friedrich Boecking, Stuttgart (DE); Sakae Sato, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 425 days.

(21) Appl. No.: 13/520,287

(22) PCT Filed: Dec. 29, 2010

(86) PCT No.: PCT/EP2010/070871

§ 371 (c)(1),
(2), (4) Date: Jul. 2, 2012

(87) PCT Pub. No.: WO2011/091937

PCT Pub. Date: Aug. 4, 2011

(65) Prior Publication Data

US 2012/0279473 A1 Nov. 8, 2012

(30) Foreign Application Priority Data

Jan. 27, 2010 (DE) ..... 10 2010 001 252

(51) Int. Cl.

| | |
|---|---|
| ***F02M 1/00*** | (2006.01) |
| ***F02M 63/02*** | (2006.01) |
| ***F02M 55/02*** | (2006.01) |
| ***F02M 59/02*** | (2006.01) |

(52) U.S. Cl.

CPC ..... *F02M 63/0265* (2013.01); *F02M 55/02* (2013.01); *F02M 59/022* (2013.01); *F02M 2200/40* (2013.01)

(58) Field of Classification Search

CPC ..... F02M 63/0225; F02M 63/0265
USPC ..... 123/446, 447, 510, 511; 477/255
See application file for complete search history.

(56) References Cited

U.S. PATENT DOCUMENTS 3,841,797 A * 10/1974 Fitzgerald ..... 417/323
3,918,851 A * 11/1975 Fitzgerald ..... 417/364

(Continued)

FOREIGN PATENT DOCUMENTS

EP 0881380 12/1998
JP S49-043618 7/1972

(Continued)

OTHER PUBLICATIONS

PCT/EP2010/070871 International Search Report dated Apr. 15, 2011 (Translation and Original, 4 pages).

*Primary Examiner* — John Kwon
(74) *Attorney, Agent, or Firm* — Michael Best & Friedrich LLP

(57) ABSTRACT

The invention relates to a fuel injection system of an internal combustion engine, comprising a high-pressure pump. A high-pressure outlet (4) of the high-pressure pump is connected to a high-pressure accumulator (23) that has at least one accumulator outlet (13*a*, 13*b*) for connecting to a fuel injector. According to the invention, a fuel injection system which is compact and operates in a highly reliable manner is provided. This is achieved in that the high-pressure accumulator (23) is directly adapted to the high-pressure pump and in that the accumulator outlet (13*a*, 13*b*) is aligned in a precisely defined position with respect to the high-pressure pump.

7 Claims, 3 Drawing Sheets

(56) References Cited

U.S. PATENT DOCUMENTS

| | | | | |
|---|---|---|---|---|
| 3,918,857 | A * | 11/1975 | Fitzgerald | 418/73 |
| 4,048,970 | A * | 9/1977 | Fitzgerald | 123/457 |
| 4,275,693 | A * | 6/1981 | Leckie | 123/447 |
| 5,143,029 | A * | 9/1992 | Christenson | 123/65 VA |
| 5,438,968 | A * | 8/1995 | Johnson et al. | 123/446 |
| 6,016,790 | A * | 1/2000 | Makino et al. | 123/496 |
| 6,330,876 | B1 | 12/2001 | Spinnler et al. | |
| 6,637,408 | B2 * | 10/2003 | Djordjevic | 123/456 |
| 2006/0102150 | A1 * | 5/2006 | Frank et al. | 123/447 |
| 2007/0227478 | A1 * | 10/2007 | Fitzgerald | 123/90.12 |
| 2007/0277785 | A1 | 12/2007 | Portner et al. | |
| 2008/0213115 | A1 * | 9/2008 | Hilger et al. | 417/569 |
| 2009/0199820 | A1 * | 8/2009 | Geyer | 123/447 |

FOREIGN PATENT DOCUMENTS

| | | |
|---|---|---|
| JP | S50-114519 | 2/1974 |
| JP | 54-17696 | 7/1979 |
| JP | H07167009 | 7/1995 |
| JP | H10331760 | 12/1998 |
| JP | 2000110692 | 4/2000 |
| JP | 2002521616 | 7/2002 |
| WO | 2006134002 | 12/2006 |

* cited by examiner

FUEL INJECTION SYSTEM WITH INTEGRATED HIGH-PRESSURE ACCUMULATOR

BACKGROUND OF THE INVENTION

The invention relates to a fuel injection system of an internal combustion engine having a high-pressure pump, wherein a high-pressure outlet of the high-pressure pump is connected to a high-pressure accumulator, which comprises at least one accumulator outlet for connecting to a fuel injector.

Such a fuel injection system is disclosed by DE 10 2005 027 851 A1. This fuel injection system having a high-pressure pump comprises two pump pistons, which are driven by a camshaft and which serve, each via a non-return valve, to deliver the fuel into a high-pressure accumulator arranged and fitted separately from the high-pressure pump. The fuel is drawn from the high-pressure accumulator for injection into combustion chambers of the internal combustion engine by means of fuel injectors, which are connected via lines to the high-pressure accumulator.

SUMMARY OF THE INVENTION

The object of the invention is to provide a fuel injection system, which is of compact and securely fitted construction.

This object is achieved in that the high-pressure accumulator is directly adapted to the high-pressure pump and that the accumulator outlet is aligned in a precisely defined position relative to the high-pressure pump. The adaptation of the high-pressure accumulator to the high-pressure pump affords the advantage that said accumulator does not have to be fitted as a separate component and suitably connected to the high-pressure pump. The precise alignment of the accumulator outlet affords the advantage that the connecting line to the fuel injector is precisely defined and no adjustment of the line is necessary in order to make the fitting more secure.

In a development of the invention the high-pressure pump comprises a pump housing having a cylinder head, and the high-pressure outlet of the high-pressure pump opens into a cylinder head wall. The opening of the high-pressure outlet into a cylinder head wall allows the compact attachment of the high-pressure accumulator directly to the cylinder head wall, for example, so that preferably two cylinder units of the internal combustion engine can be served by one high-pressure accumulator (although in principle it is also possible to supply one, three or four cylinder units).

In a further embodiment of the invention the high-pressure accumulator is embodied as a distribution element interacting with the high-pressure outlet. In the case of a high-pressure pump inserted into the cylinder head of an internal combustion engine, this distribution element is preferably fitted to a wall of the cylinder head of the high-pressure pump and—as previously stated—preferably serves two cylinder units of the internal combustion engine. Such a distribution element having a cylindrical, cupped design is especially suitable, since it can be readily manufactured and the cupped interior offers a sufficiently large accumulator capacity for the high-pressure accumulator. In an alternative embodiment the distribution element may also be of cylindrical tube-shaped design, at least the one accumulator outlet then being sited laterally on the cylindrical tube-shaped distribution element.

In a development of the invention the distribution element comprises one, two, three or four accumulator outlets. Here the accumulator outlets are preferably arranged at an angle other than an angle of 0° to its cylinder longitudinal axis. This arrangement firstly allows the adaptation of more than one accumulator outlet to the distribution element, but on the other hand necessitates precise alignment of the distribution element, in order to be able to connect at least the one connecting line to the fuel injector with adjustment operations.

In a development of the invention the distribution element is fastened to the cylinder head wall by means of a holder. In principle it would be possible to screw the distribution element, provided with a thread, for example, directly to the cylinder head wall. Then, however, the alignment of the accumulator outlets would be ensured only through a precisely defined screwed attachment position. The use of a holder allows the distribution element to be aligned precisely in relation to the cylinder head, for example through a corresponding marking (or an alignment device explained below), and then fastened to the cylinder head wall by means of the holder.

In a further embodiment the holder is a clamping screw, which, for example, is screwed together with a threaded connector on the cylinder head. Here the clamping screw comprises a supporting flange, which rests on an annular flange of the distribution element. Alternatively, however, the clamping screw may also be embodied as a double-acting screw having a right-hand thread and a left-hand thread and may interact with corresponding threads on the cylinder head and the distribution element.

In a development of the invention the distribution element comprises an alignment device interacting with the high-pressure outlet or the cylinder head, for example a device in the form of at least one lug, which interacts with a corresponding recess. The necessary alignment is thereby then achieved directly and precisely without further optical alignment.

In a further embodiment the distribution element, opposite the connection side to the high-pressure outlet or the cylinder head, comprises a connection aperture for a closing cover or a rail pressure sensor. This embodiment can be used to particular advantage when the distribution element is of cylindrical tube-shaped design.

BRIEF DESCRIPTION OF THE DRAWINGS

Further advantageous embodiments of the invention are set forth in the description of the drawings, in which exemplary embodiments of the invention represented in the figures are described in more detail. In the figures.

DETAILED DESCRIPTION

Figure 1:
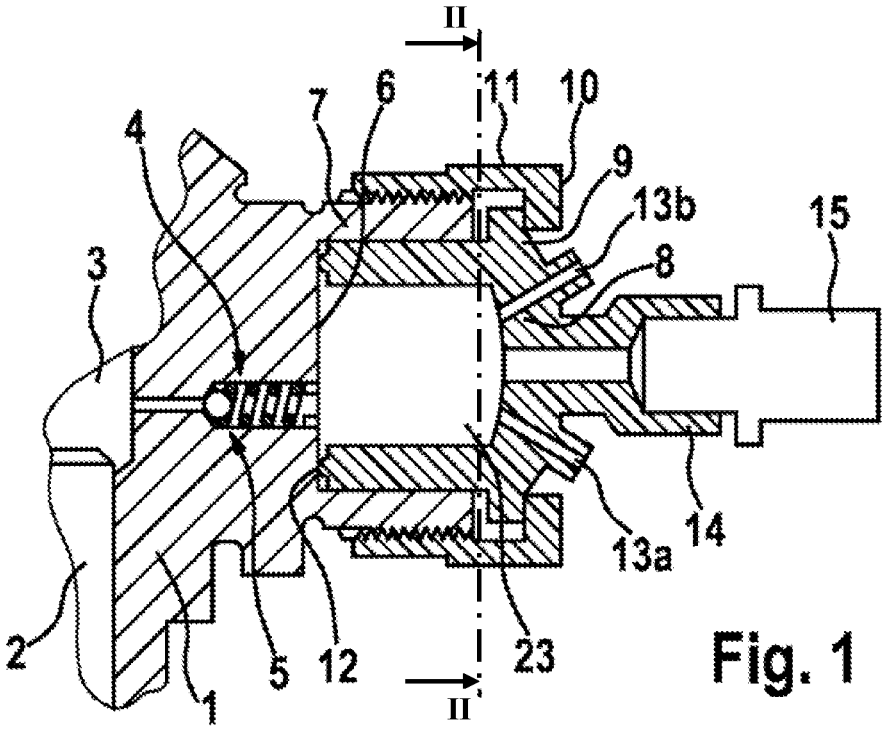
FIG. 1 shows a sectional representation of a distribution element of cupped design.

According to FIG. 1 the high-pressure pump of a fuel injection system of an internal combustion engine comprises a pump housing having a cylinder head 1, wherein a partially represented pump piston 2 is guided in a cylinder bore of the cylinder head 1 and delivers the fuel from a delivery chamber 3 via a high-pressure outlet 4, into which a pressurizing valve 5 is connected, into a high-pressure accumulator 23. The high-pressure outlet 4 opens into a cylinder head wall 6 of the cylinder head 1 of the high-pressure pump. Formed on to the cylinder head wall 6 is an annular threaded connector 7, into which a distribution element 8 of cupped design is inserted, the interior of which forms the high-pressure accumulator 23. The high-pressure pump may be fitted into a cylinder head of the internal combustion engine and then does not have a drive shaft of its own but is driven by a shaft of the internal combustion engine, for example the camshaft thereof. Alternatively, the high-pressure pump may also have a driveshaft of its own, which is driven by the internal combustion engine.

The cupped distribution element 8 comprises an annular flange 9, on which a corresponding supporting flange 10 of a clamping screw 11 grips. The clamping screw 11 is screwed together with the threaded connector 7 and presses the distribution element 8 on to the cylinder head wall 6 of the cylinder head 1 of the high-pressure pump. To ensure a tight connection, the cupped distribution element 8 has a sealing geometry 12 on the side facing the cylinder head wall 6. Alternatively a seal is inserted between the corresponding components.

On the opposite side of the distribution element 8, two accumulator outlets 13*a*, 13*b*, for example, on which lines can screwed for connecting to fuel injectors, are let into the base wall. The number of accumulator outlets 13 (for example two, three or four) depends on the number of cylinders of the internal combustion engine, since a fuel injector is assigned to each cylinder unit. Finally the distribution element comprises yet another connection 14, to which a rail pressure sensor 15 can be connected. The rail pressure sensor serves to register the fuel pressure in the high-pressure accumulator 23 for controlling the fuel refill quantity.

Figure 2:
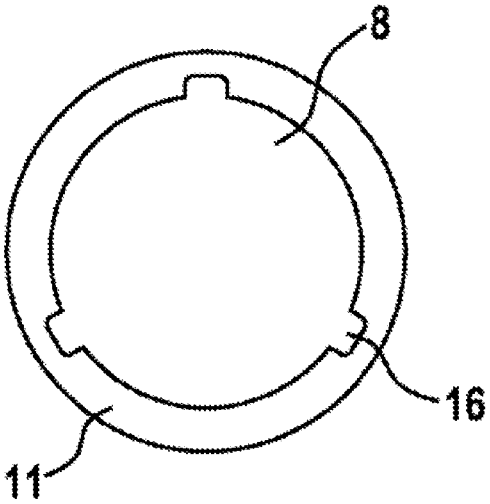
FIG. 2 shows a detail view of an alignment device of the distribution element taken through section line II-II of FIG. 1.

FIG. 2 shows the cupped distribution element 8, which is provided with alignment devices 16 in the form of three circumferentially distributed lugs. These lugs engage in corresponding recesses in the threaded connector 7 (or vice-versa) and ensure a precise alignment of the distribution element 8 relative to the cylinder head wall 6. The number of lugs preferably corresponds to the number of accumulator outlets 13, in order to ensure a precise assignment and alignment. For example, two accumulator outlets 13 are arranged opposite one another (180°), as are the lugs, whereas three accumulator outlets as well as the lugs are arranged rotationally staggered by 120°, and four accumulator outlets by 90° in relation to one another.

Figure 3:
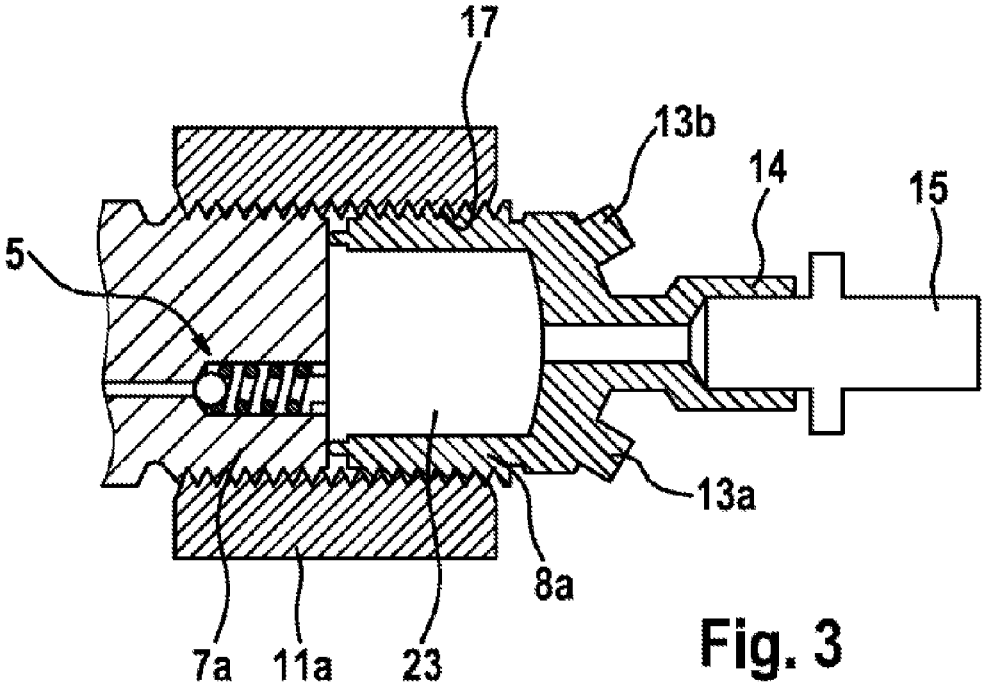
FIG. 3 shows an alternative embodiment of the fastening of the distribution element on the cylinder head.

In the exemplary embodiment according to FIG. 3 the threaded connector 7*a* is directly integrated into the cylinder head 1, and the clamping screw 11*a* is designed as a double acting screw having a right-hand thread and a left-hand thread. Accordingly the distribution element 8*a* here also has an external thread 17, so that when screwing the clamping screw 11*a* the distribution element 8*a* is screwed together with the threaded connector 7*a*. The further design of the distribution element 8*a* is very similar to FIG. 1.

Figure 4:
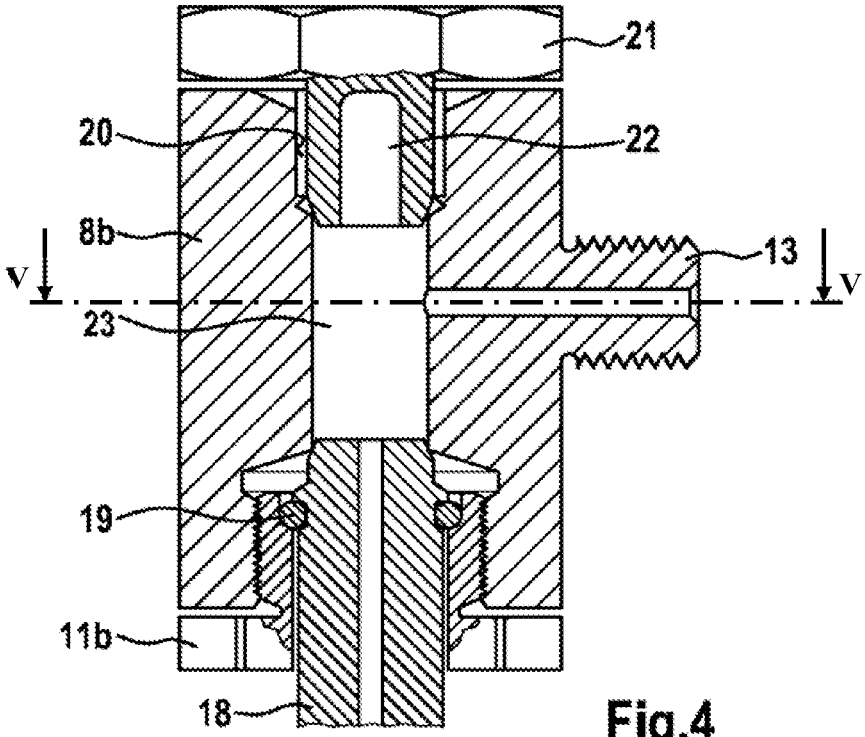
FIG. 4 shows a sectional representation of an alternative distribution element of cylindrical tube-shaped design.

In the exemplary embodiment according to FIG. 4, the distribution element 8*b* is of cylindrical tube-shaped design and is screwed together with a connector 18, which interacts with cylinder head wall 6, by means of a clamping screw 11*b*. In its function the connector 18 corresponds to the threaded connectors 7, 7*a*. The clamping screw 11*b* is supported on a clamping ring 19, which is inserted into a circumferential groove of the connector 18, and at the same time is screwed into an internal thread of the distribution element 8*b*. An alignment device (not shown) and a sealing geometry are provided between the connector 18 and the distribution element 8*b*.

Opposite the connector 18 a closing cover 21 is screwed into a connection aperture 20 of the distribution element 8*b*. Alternatively the rail pressure sensor may also be screwed in here. The closing cover 21 screwed into the connection aperture 20 has a recess 22, which causes the fuel pressure acting inside the recess 22 to exert a radial pressure on the screwed connection. Any expansion of the distribution element 8*b* is thereby compensated for, thus enhancing the efficiency of the seal.

Figure 5:
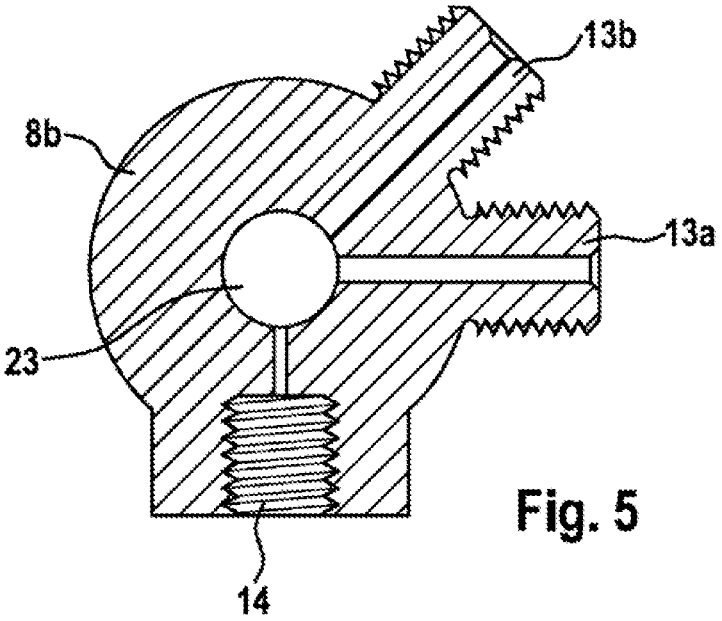
FIG. 5 shows a cross-sectional representation through the distribution element of cylindrical tube-shaped design taken through section line V-V of to FIG. 4.

FIG. 5 in a cross-sectional representation shows the distribution element 8*b* with two accumulator outlets 13*a*, 13*b*, for example, and a further connection 14 for the rail pressure sensor. Here too, the number of actual accumulator outlets 13 (for example two, three or four) depends on the number of cylinders of the internal combustion engine, since a fuel injector is assigned to each cylinder unit.

The invention claimed is:

1. A fuel injection system of an internal combustion engine having a high-pressure pump, wherein a high-pressure outlet (4) of the high-pressure pump is connected to a high-pressure accumulator (23), which comprises at least one accumulator outlet (13*a*, 13*b*) for connecting to a fuel injector, wherein the high-pressure accumulator (23) is directly adapted to the high-pressure pump, wherein the high-pressure pump comprises a pump housing having a cylinder head (1), in which a pump piston (2) is guided in a cylinder bore, wherein the high-pressure outlet (4) opens into a cylinder head wall (6) of the cylinder head (1) wherein the high pressure accumulator (23) is embodied as a distribution element (8, 8*a*, 8*b*) interacting with the high pressure outlet (4) or the cylinder head (1), in such a way that the accumulator outlet (13*a*, 13*b*) is aligned in a precisely defined position in which a fuel line of the fuel injector is aligned with the accumulator outlet (13*a*, 13*b*), and wherein the distribution element (8, 8*a*, 8*b*) is of cupped or cylindrical tube-shaped design and in that the distribution element (8, 8*a*, 8*b*) is fastened to a connector (7, 7*a*, 18) arranged on the cylinder head wall (6).

2. The fuel injection system as claimed in claim 1, characterized in that the distribution element (8) comprises two, three or four accumulator outlets (13).

3. The fuel injection system as claimed in claim 1, characterized in that that the distribution element (8, 8*a*, 8*b*) is fastened to the connector (7, 7*a*, 18) via a holder.

4. The fuel injection system as claimed in claim 3, characterized in that the holder is a clamping screw (11, 11*a*, 11*b*).

5. The fuel injection system as claimed in claim 3, characterized in that the distribution element (8, 8*a*, 8*b*) comprises an alignment device (16) interacting with the high-pressure outlet (4) or the cylinder head (1).

6. The fuel injection system as claimed in claim 1, characterized in that the distribution element (8*b*), opposite of a connection side to the high-pressure outlet (4) or the cylinder head (1), comprises a connection aperture (20) for a closing cover (21) or a rail pressure sensor (15).

7. The fuel injection system as claimed in claim 1, characterized in that the high-pressure accumulator (23) is directly connected to the cylinder head (1).

* * * * *